US009033385B2

(12) United States Patent
Sgroi, Jr.

(10) Patent No.: US 9,033,385 B2
(45) Date of Patent: May 19, 2015

(54) TRASH SPEARING TOOLS WITH RETRACTABLE SPEARING PINS

(71) Applicant: Unger Marketing International, LLC, Bridgeport, CT (US)

(72) Inventor: Anthony Sgroi, Jr., Wallingford, CT (US)

(73) Assignee: Unger Marketing International, LLC, Bridgeport, CT (US)

( * ) Notice: Subject to any disclaimer, the term of this patent is extended or adjusted under 35 U.S.C. 154(b) by 0 days.

(21) Appl. No.: 14/491,673

(22) Filed: Sep. 19, 2014

(65) Prior Publication Data

US 2015/0076848 A1 Mar. 19, 2015

Related U.S. Application Data

(60) Provisional application No. 61/879,847, filed on Sep. 19, 2013.

(51) Int. Cl.
*B08B 1/00* (2006.01)
*E01H 1/12* (2006.01)

(52) U.S. Cl.
CPC ..... *E01H 1/12* (2013.01); *E01H 2001/1233* (2013.01); *E01H 2001/1293* (2013.01)

(58) Field of Classification Search
USPC ..... 294/61, 182, 209, 210, 120; 15/104.8, 15/257.1, 257.6
See application file for complete search history.

(56) References Cited

U.S. PATENT DOCUMENTS 2,194,016 A * 3/1940 Geller ..... 43/6
2,642,306 A * 6/1953 Beeler ..... 294/61
2,794,667 A * 6/1957 Bissitt ..... 294/50.7
2,800,354 A 7/1957 King
2,804,336 A 8/1957 Thompson
2,852,298 A 9/1958 Tunstall, Sr.
2,989,334 A * 6/1961 Browne ..... 294/104

(Continued)

FOREIGN PATENT DOCUMENTS

DE 4306118 C1 5/1994
ES 1064085 U 2/2007
GB 2255492 A 11/1992

OTHER PUBLICATIONS

International Search Report dated Nov. 4, 2014 for corresponding PCT Application No. PCT/US2014/043927, 2 pages.

(Continued)

*Primary Examiner* — Kaitlin Joerger
*Assistant Examiner* — Gabriela Puig
(74) *Attorney, Agent, or Firm* — Ohlandt, Greeley, Ruggiero & Perle, LLP

(57) ABSTRACT

A trash spearing tool and method are provided. The tool includes a spearing pin, a trigger assembly, an inner tube, and an outer tube. The trigger assembly is movable between a normal position and an activated position. The outer tube is slidable between a storage position and a use position. The spearing pin is operatively coupled to the trigger assembly in such manner that, when the outer tube is in the use position and the trigger assembly is in the normal position, the spearing pin is normally biased to an extended position in which a portion of the spearing pin extends from the outer tube and, when the outer tube is in the storage position and the trigger assembly is in either the normal position or use position, the spearing pin to in a retracted position in which the spearing pin does not extend from the outer tube.

13 Claims, 8 Drawing Sheets

(56) References Cited

U.S. PATENT DOCUMENTS

| | | | | | |
|---|---|---|---|---|---|
| 3,105,715 | A | * | 10/1963 | Happ | 294/61 |
| 3,183,031 | A | | 5/1965 | Haberstick | |
| 3,394,694 | A | | 7/1968 | Leclerc | |
| 3,526,424 | A | * | 9/1970 | Torres | 294/24 |
| 4,081,192 | A | | 3/1978 | Jones | |
| 4,183,570 | A | * | 1/1980 | Broyles et al. | 294/61 |
| 4,214,770 | A | * | 7/1980 | Agins | 280/819 |
| 4,502,722 | A | * | 3/1985 | Rocquin | 294/61 |
| 4,655,495 | A | | 4/1987 | Naff, Jr. | |
| 4,665,495 | A | | 5/1987 | Thaden | |
| 4,743,040 | A | | 5/1988 | Breveglieri et al. | |
| 4,856,835 | A | | 8/1989 | Pacione | |
| 4,909,554 | A | | 3/1990 | Pacione | |
| 5,193,871 | A | * | 3/1993 | Williams | 294/61 |
| 5,261,496 | A | * | 11/1993 | Smotherman | 172/25 |
| 5,370,433 | A | | 12/1994 | Yost | |
| 6,050,626 | A | * | 4/2000 | Dudley | 294/61 |
| 6,457,758 | B1 | * | 10/2002 | Gerdes | 294/61 |
| 7,784,257 | B2 | | 8/2010 | Williams et al. | |
| 8,002,319 | B1 | * | 8/2011 | Hahn | 294/1.4 |
| 8,276,277 | B2 | * | 10/2012 | Blier et al. | 30/129 |
| 2002/0109318 | A1 | | 8/2002 | Calmeise et al. | |
| 2006/0163827 | A1 | | 7/2006 | Lauer et al. | |
| 2009/0189498 | A1 | | 7/2009 | Catron et al. | |
| 2010/0102193 | A1 | | 4/2010 | Lindner et al. | |

OTHER PUBLICATIONS

Written Opinion dated Nov. 4, 2014 for corresponding PCT Application No. PCT/US2014/043927, 2 pages.

International Search Report, dated Dec. 23, 2014 corresponding with PCT Application No. PCT/US14/56634, 3 pages.

International Search Report, dated Dec. 23, 2014 corresponding with PCT Application No. PCT/US14/56634, 4 pages.

* cited by examiner

TRASH SPEARING TOOLS WITH RETRACTABLE SPEARING PINS

CROSS REFERENCE TO RELATED APPLICATION

This application claims the benefit of U.S. Provisional Application No. 61/879,847 filed on Sep. 19, 2013, the entire contents of which are incorporated by reference herein.

BACKGROUND OF THE INVENTION

1. Field of the Invention

The present disclosure is related to trash spearing tools. More particularly, the present disclosure is related to trash spearing tools that have retractable spearing pins that can be used to strip trash collected on the pins.

2. Description of Related Art

The picking up or cleaning up of trash and debris from the ground is an unfortunately necessity in today's world. Stooping or bending to manual pick-up the trash presents certain dangers or risks depending on the physical health of the knees, back, and other joints of the person or persons collecting the trash. Thus, tools have been developed to extend the reach of the user so as to pick up trash or debris with little or no stooping or bending.

The tools can include complex devices such as but not limited to trigger operated pinching tools that can grasp and release trash and debris. Additionally, the tools can include simple devices such as poles with sharpened pins that can be used to spear trash and debris.

It has been determined by the present disclosure that there is a continuing need for improved tools that overcome, alleviate, and/or mitigate one or more deleterious effects associated with the prior art.

SUMMARY

A trash spearing tool and method are provided. The tool includes a spearing pin, a trigger assembly, an inner tube, and an outer tube. The trigger assembly is movable between a normal position and an activated position. The inner tube depends from the trigger assembly. The outer tube is disposed over a portion the inner tube and is slidable between a storage position and a use position. The spearing pin is operatively coupled to the trigger assembly in such manner that, when the outer tube is in the use position and the trigger assembly is in the normal position, the spearing pin is normally biased to an extended position in which a portion of the spearing pin extends from the outer tube and, when the outer tube is in the storage position and the trigger assembly is in either the normal position or use position, the spearing pin to in a retracted position in which the spearing pin does not extend from the outer tube.

In some embodiments, the trash spearing tool is configured so that, when the outer tube is in the use position, movement of the trigger assembly from the normal position to the activated position moves the spearing pin to the retracted position.

In some embodiments alone or in combination with one or more of the above referenced embodiments, the spearing pin is operatively coupled to the trigger assembly by a link rod, a spring retainer, and a biasing member, the spring retainer being secured in the inner tube and having a bore through which the link rod passes, the bore being sufficient to allow the link rod to move through the spring retainer.

In some embodiments alone or in combination with one or more of the above referenced embodiments, the biasing member is within the inner tube and acts on the spring retainer and the spearing pin to normally bias the spearing pin to the extended position and to bias the trigger assembly to the normal position.

In some embodiments alone or in combination with one or more of the above referenced embodiments, the trash spearing tool, when the outer tube is in the use position, movement of the trigger assembly from the normal position to the activated position overcomes the force of the biasing member to move the spearing pin to the retracted position.

In some embodiments alone or in combination with one or more of the above referenced embodiments, the biasing member is a compression spring.

In some embodiments alone or in combination with one or more of the above referenced embodiments, the trash spearing tool includes a pin retainer, the biasing member being operatively positioned between the pin retainer and the spring retainer.

In some embodiments alone or in combination with one or more of the above referenced embodiments, the spearing pin is removably secured to the pin retainer.

In some embodiments alone or in combination with one or more of the above referenced embodiments, the spearing pin is connected to or unitary with a pin housing, the pin housing being removably connected to pin retainer by at least one connector.

In some embodiments alone or in combination with one or more of the above referenced embodiments, the trash spearing tool further includes one or more openings defined through the outer tube and a retractable detent removably receivable in the one or more openings to secure the outer tube in a desired location with respect to inner tube.

In some embodiments alone or in combination with one or more of the above referenced embodiments, the trigger assembly comprises a trigger, a trigger lock, and a second biasing member, the trigger being pivotable about a pivot point between the normal and activated positions, the second biasing member biasing the trigger lock to a locked position that prevents pivoting of the trigger from the normal position, and, thus, to prevent movement of the spearing pin from the extended position, when the outer tube is in the use position.

In some embodiments alone or in combination with one or more of the above referenced embodiments, the trigger lock is movable from the locked position to an unlocked position that allows pivoting of the trigger from the normal position to the activated position, and, thus, to allow movement of the spearing pin to the retracted position, when the outer tube is in the use position.

In some embodiments alone or in combination with one or more of the above referenced embodiments, the trigger assembly further includes a rear member, the trigger having an angle with respect to the rear member in the normal position, and wherein the trigger lock is positioned on the trigger in such a manner that pulling back on the trigger while resting a user's fingers on the trigger lock is sufficient to both move the trigger lock from the locked position to the unlocked position and move the trigger from the normal position to the activated position.

A method of collecting trash is provided. The method includes using a spearing pin, extending from an outer tube, to spear the trash while a trigger assembly is in a normal position, and stripping the trash from the spearing pin.

In some embodiments the step of stripping the trash includes manually moving the outer tube with respect to the spearing pin from a use position to a storage position while leaving the trigger assembly in the normal position.

In some embodiments, the step of stripping the trash comprises retracting the spearing pin into the outer tube by moving the trigger assembly from the normal position to an activated position.

In some embodiments alone or in combination with one or more of the above referenced embodiments, the step of moving the trigger assembly from the normal position to an activated position comprises simultaneously and with one hand pulling a trigger of the trigger assembly and moving a trigger lock to an unlocked position.

The above-described and other features and advantages of the present disclosure will be appreciated and understood by those skilled in the art from the following detailed description, drawings, and appended claims.

DETAILED DESCRIPTION OF THE INVENTION

Figure 1:
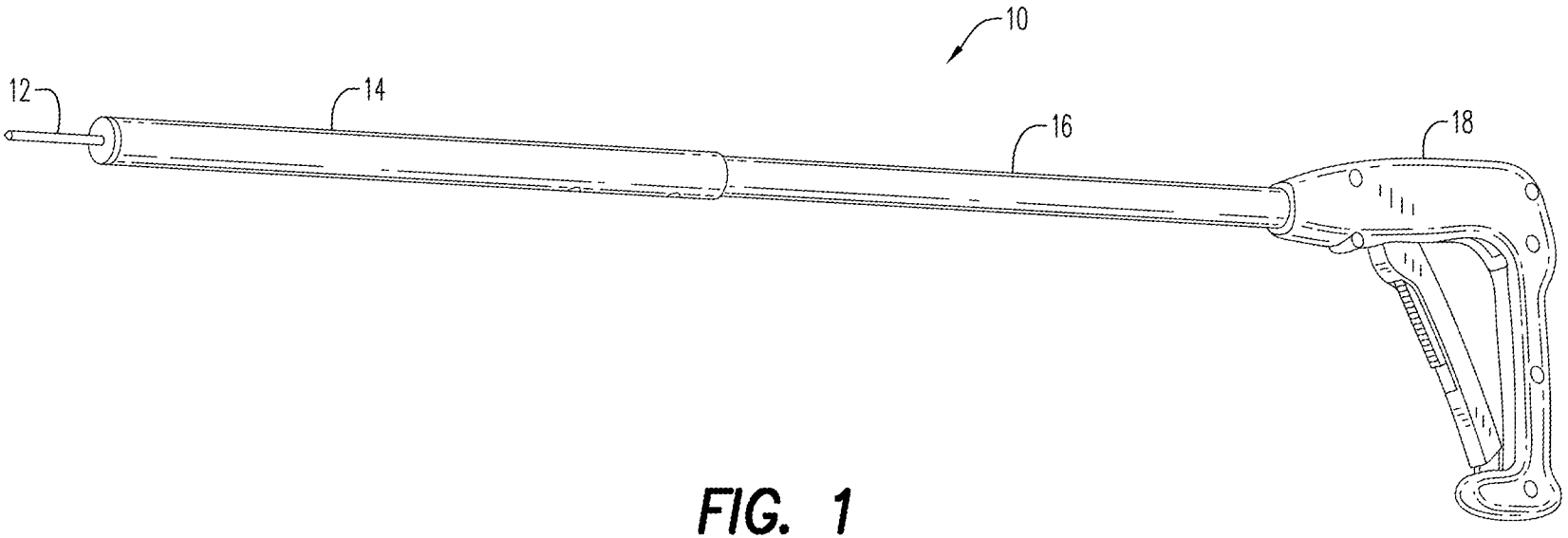
FIG. 1 illustrates an exemplary embodiment of a trash spearing tool according to the present disclosure in a use or extended position.

Referring to the drawings and in particular to FIG. 1, an exemplary embodiment of a trash spearing tool is shown and is referred to by reference numeral 10. Tool 10 includes a spearing pin 12, an outer tube 14, an inner tube 16, and a trigger assembly 18.

Tool 10 is shown in FIG. 1 having pin 12 in a use or extended position, which allows the user to spear or collect trash on the pin without having to bend or stoop. Tool 10 is configured to maintain pin 12 in the use or extended position until it is desired to either store the tool or to remove collected trash from the pin.

Figure 2:
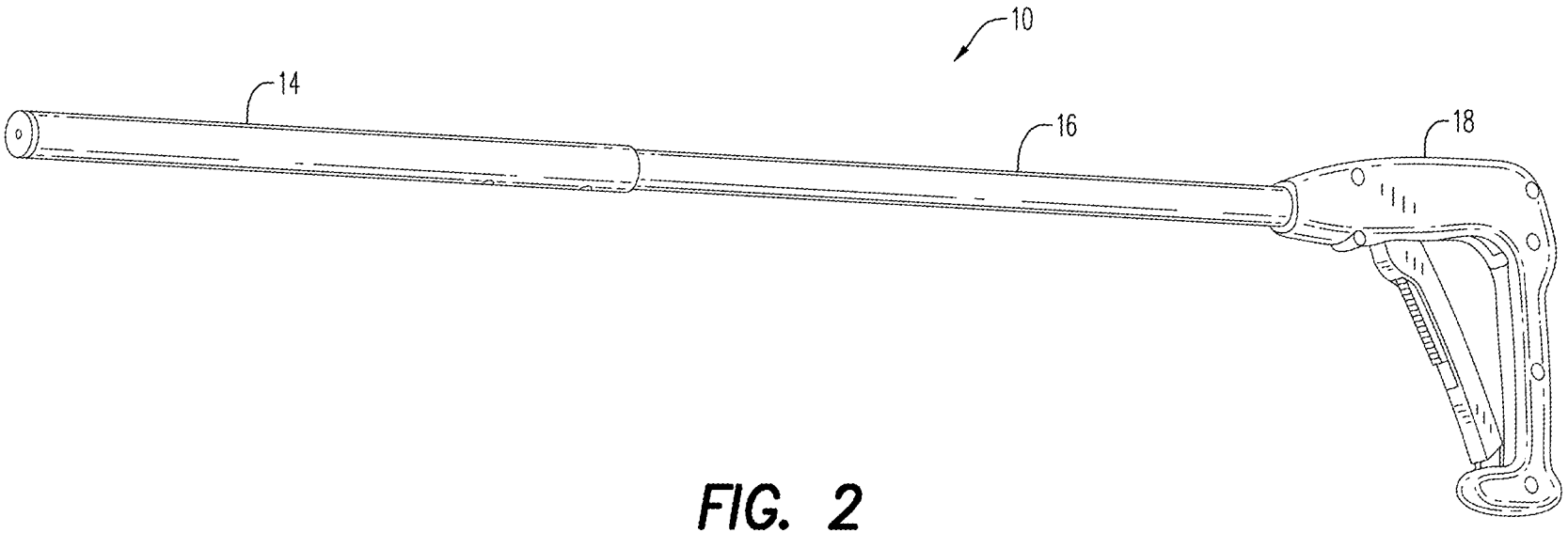
FIG. 2 illustrates the tool of FIG. 1 in a safe or storage position.

Tool 10 is shown in a safe or storage position in FIG. 2. When tool 10 is not in use, outer tube 14 can be manually slid on inner tube 16 towards pin 12 (i.e., away from trigger assembly 18) until the outer tube covers the pin. In this manner, tool 10 can be rendered in the safe or storage position as shown in FIG. 2. Additionally, manual movement of outer tube 14 to the safe or storage position of FIG. 2 can also be used to manually strip trash from pin 12 without having to touch or handle the trash and without activating trigger assembly 18.

Figure 3:
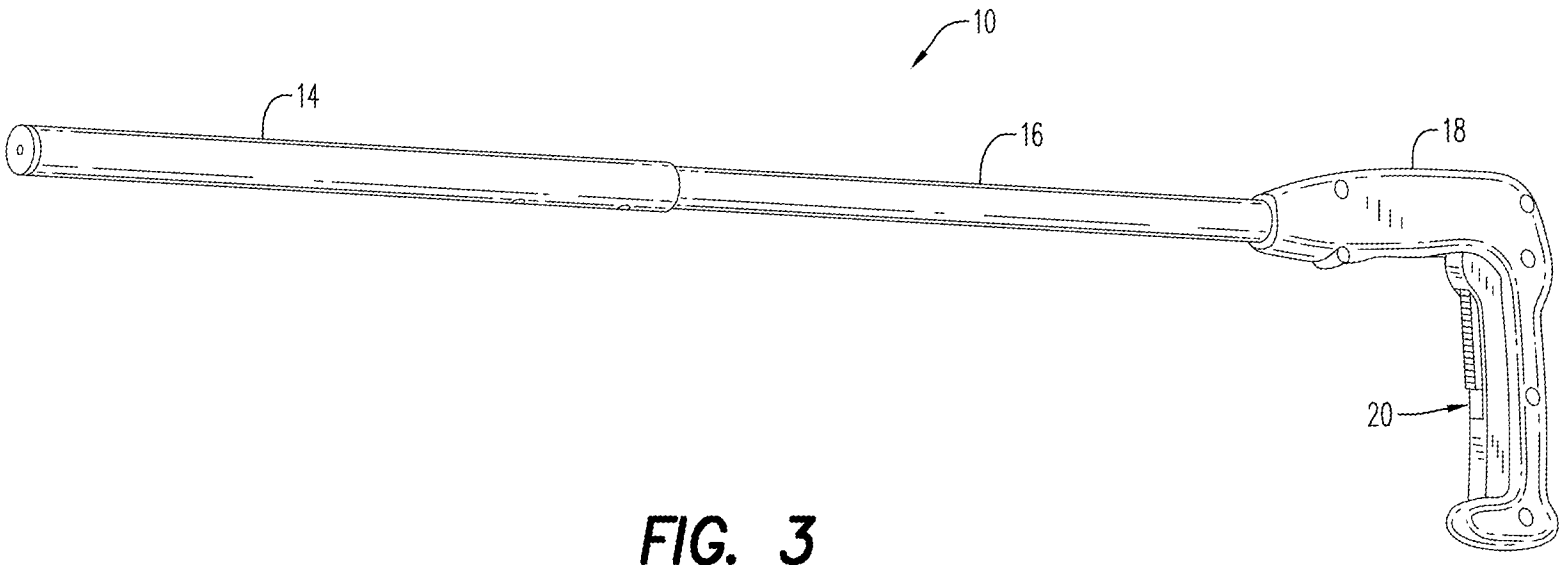
FIG. 3 illustrates the tool of FIG. 1 in a retracted or stripping position.

Tool 10 is shown in a retracted or stripping position in FIG. 3. When tool 10 is in use and trash has been collected or speared on pin 12, trigger assembly 18 can be used, by moving trigger 20 from a first or normal position (FIGS. 1 and 2) to a second or activated position (FIG. 3), to retract the pin into outer tube 14. As pin 12 retracts into outer tube 14, the outer tube strips the collected trash from the pin. After stripping trash from pin 12, the trigger can be released and returned from the second position (FIG. 3) to the first position (FIGS. 1 and 2) so that trigger assembly 18 moves pin 12 back to the use or extended position of FIG. 1.

Figure 4:
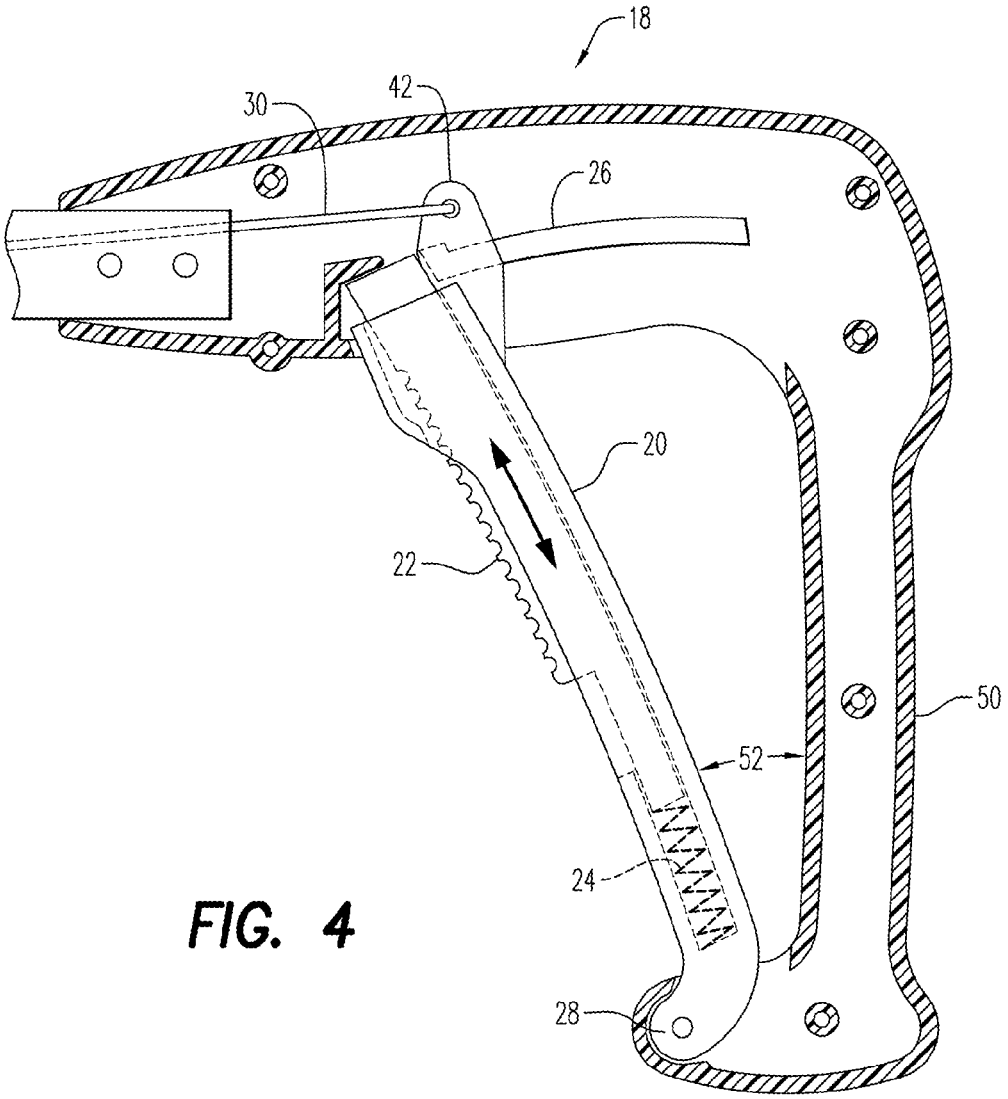
FIG. 4 illustrates an exemplary embodiment of a trigger assembly of the tool of FIG. 1 in a first or normal position.
Figure 5:
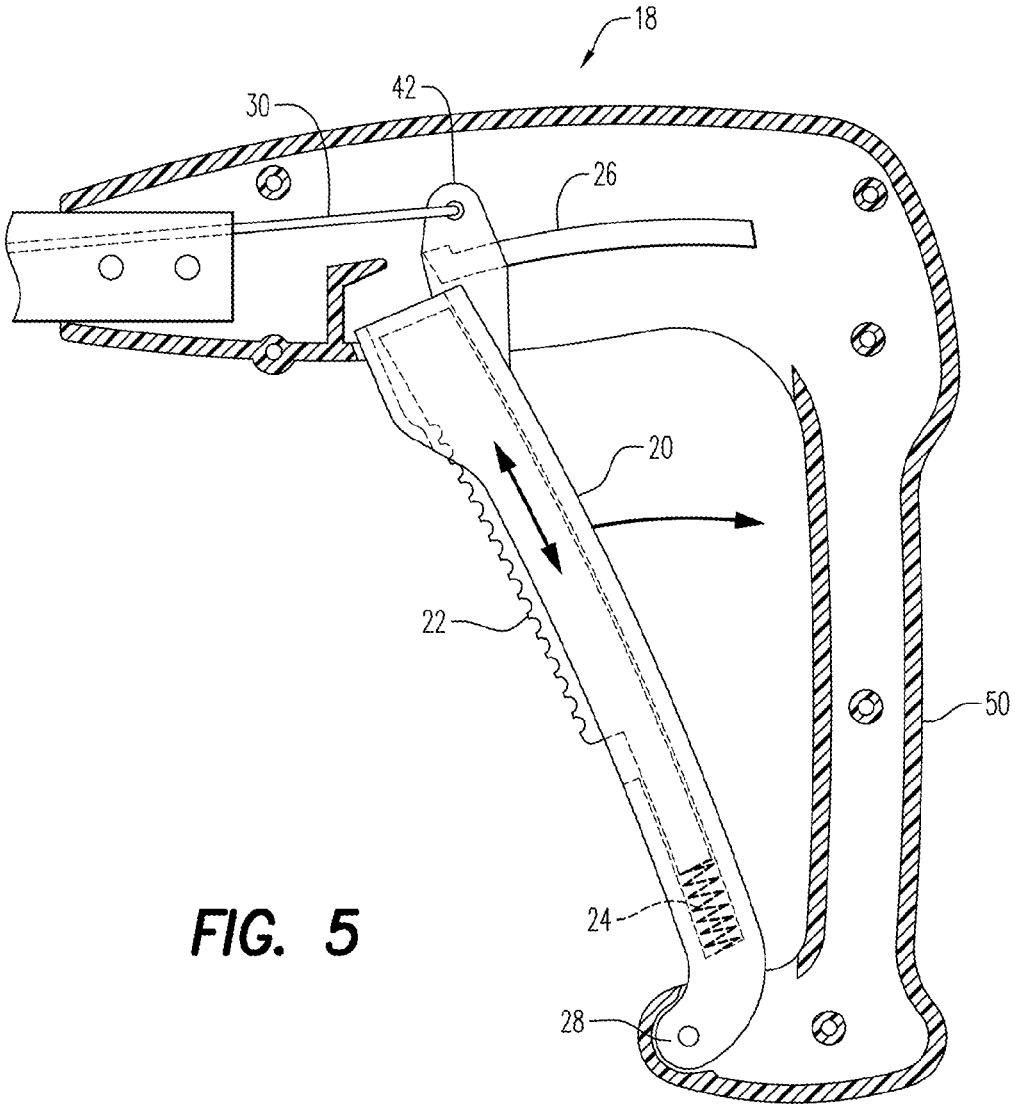
FIG. 5 illustrates an exemplary embodiment of the trigger assembly of FIG. 4 in a second or activated position.

The operation of trigger assembly 18 is described with simultaneous reference to FIGS. 4-5. Trigger assembly 18 includes a trigger 20, trigger lock 22, a lock return biasing member 24, a blocking member 26, and a pivot point 28.

As seen in FIG. 4, biasing member 24 normally biases trigger lock 22 into an upper position where blocking member 26 interferes with or contacts the trigger lock to prevent movement of trigger 20 about pivot point 28. Thus, trigger 20 is maintained in a first or normal position by trigger lock 22. As will be described in detail below, trigger 20 remains locked in the first position when tool 10 is in the extended or use position of FIG. 1 and in the safe or storage position of FIG. 2. In other words, trigger 20 is locked in the first position by trigger lock 22 to prevent pin 12 from retracting into outer tube 14 when the user spears trash or when covered by the outer tube.

Conversely and as seen in FIG. 5, trigger lock 22 can be moved downward by overcoming the force of biasing member 24. In this position, blocking member 26 no longer interferes with or contacts trigger lock 22 to allow movement of trigger 20 about pivot point 28. Thus, trigger 20 can be pivoted to a second or activated position when trigger lock 22 has been depressed downward.

Tool 10 further includes a link rod 30 that operatively connects trigger assembly 18 and pin 12 to one another. Thus, movement of trigger 20 from the first or normal position (FIGS. 1 and 2) to the second or activated position (FIG. 3) also results in link rod 30 sliding rearward (i.e., towards trigger assembly 18) within outer and inner tubes 14, 16 to retract pin 12 into the outer tube. In this manner, the user can selectively lock/unlock and depress/release trigger 20, which allows the user to selectively strip trash from pin 12.

Figure 6:
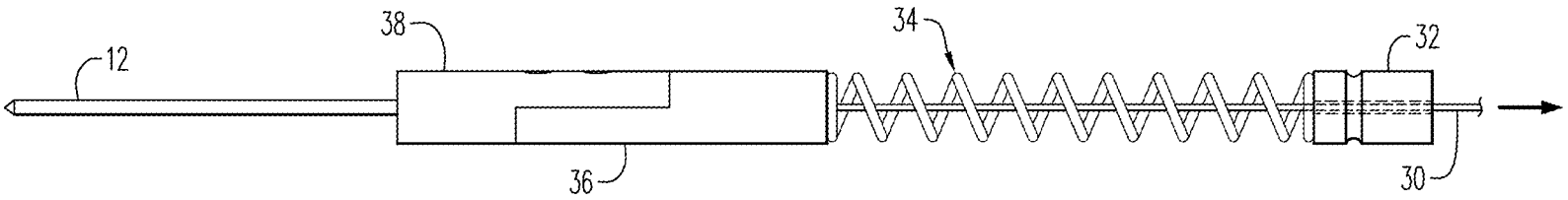
FIG. 6 illustrates an exemplary embodiment of a link rod according to the present disclosure.
Figure 7:
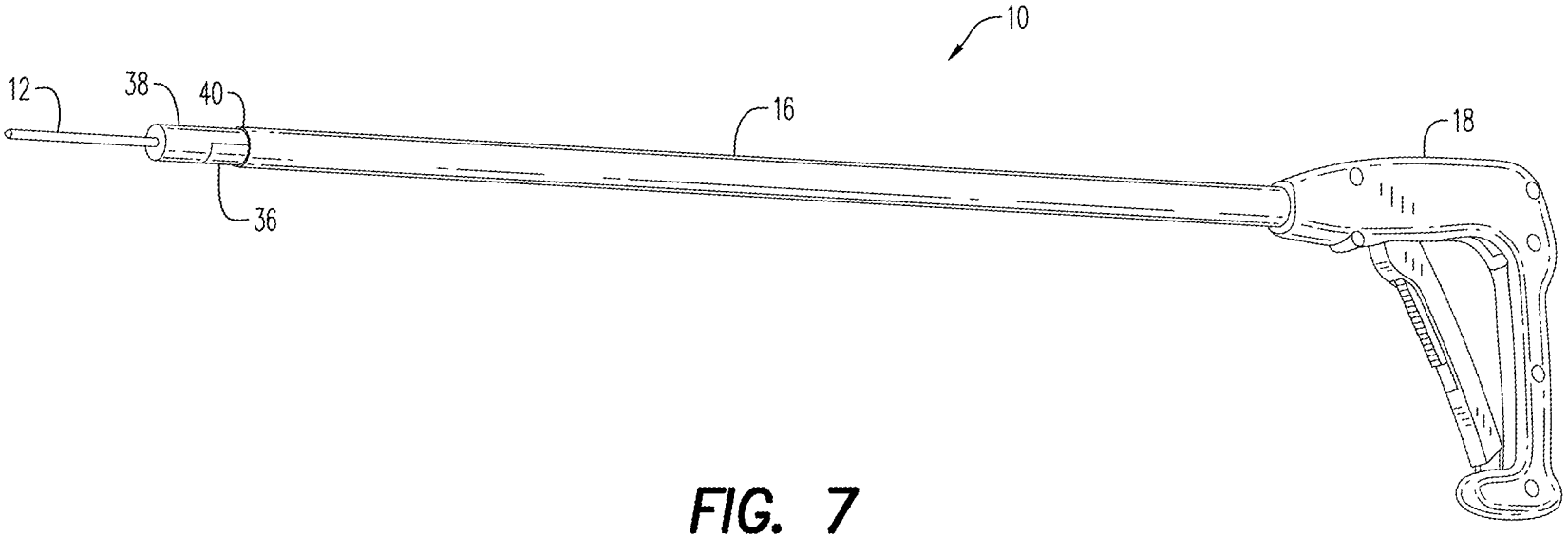
FIG. 7 illustrates the tool of FIG. 1 having the outer tube removed.

An exemplary embodiment of the operative coupling of link rod 30 and pin 12 is shown in FIGS. 6-7. The coupling includes spring retainer 32, a biasing member 34, and a pin retainer 36, which is secured to or unitary with link rod 30.

Spring retainer 32 is secured in inner tube 16 and has a bore to allow link rod 30 to move back-and-forth through the retainer. In the illustrated embodiment, where biasing member 34 is a compression spring, spring retainer 32 is secured near an end 40 of inner tube 16 where the inner tube mates with outer tube 14. Of course, it is contemplated by the present disclosure for spring retainer 32 and biasing member 34 to be located in any desired position to provide the functionality described herein—namely to normally bias pin 12 to the extended or use position.

During assembly, the link rod 30 is inserted through end 40 so that biasing member 34 is retained between pin retainer 36 and spring retainer 32 and is connected to trigger assembly 18 via point 42 of trigger 20. In this position, biasing member 34 biases link rod 30 to the extended or use position and, thus, biases trigger 20 to the first position.

Figure 8:
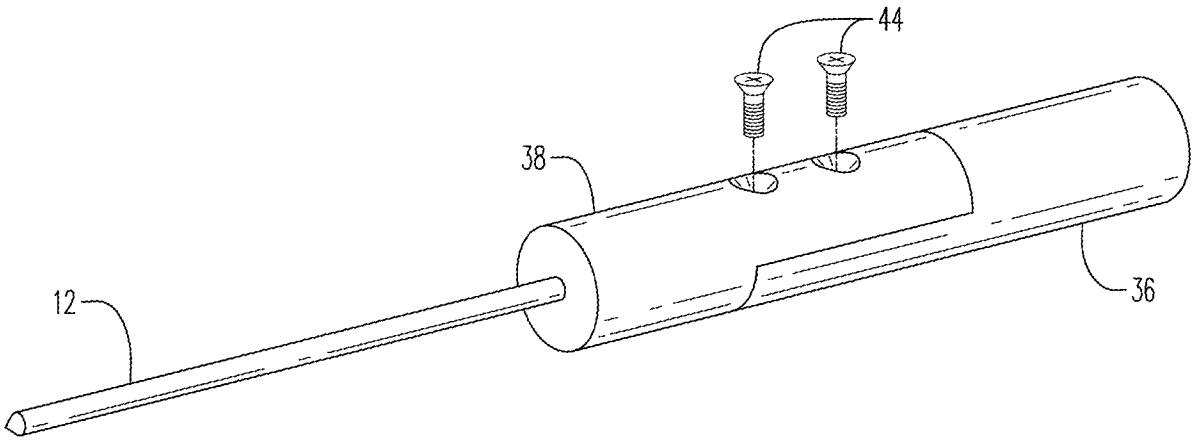
FIG. 8 illustrates the pin housing and pin retainer of FIG. 7.

Pin 12 is connected to or unitary with a pin housing 38. Pin housing 38 is removably connected to pin retainer 36. In this manner, pin 12 can easily be replaced in the event of damage or wear by simply disconnecting pin housing 38 from pin retainer 36. For example and as shown in FIG. 8, pin housing 38 and pin retainer 36 are connected by one or more screws 44. Preferably and as shown in FIG. 7, access to remove pin housing 38 from pin retainer 36 can be had by removal of outer tube 14 from inner tube 16 to allow access to end 40 of the inner tube 16.

Figure 9:
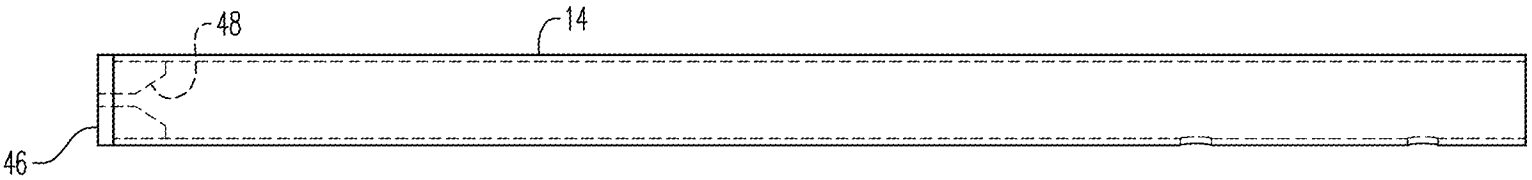
FIG. 9 illustrates an exemplary embodiment of an outer tube according to the present disclosure.

Outer tube 14 is shown in detail in FIG. 9. Outer tube 14 can include an end cap 46 having a tapered bore 48 to assist in aligning pin 12 with the outer tube during extension and retraction therefrom.

Additionally and as discussed above, outer tube 14 can be moved or slid with respect to inner tube 16 among the use or extended position of FIG. 1, the safe or storage position of FIG. 2, and to remove the outer tube from the inner tube to expose end 40 of the inner tube for replacement of pin 12. Outer tube 14 can preferably be releasably secured in one or more desired positions. For example, outer tube 14 can include one or more openings defined therethrough, while inner tube 16 can include a retractable detent (not shown) that is received in any of the opening to secure the outer tube in a desired location with respect to inner tube.

During normal use, the user will use tool 10 spear or impale trash on the ground using pin 12 when the pin is in the use or extended position of FIG. 1. Once trash has been collected on pin 12, the user will move the end of tool 10 having the trash impaled thereon over or into a trash receptacle. To eject or strip the trash from pin 12 and into the receptacle and referring again to FIG. 4, the user will grasp trigger assembly 18 with their thumb wrapped around rear member 50 and their fingers rest on at least part of trigger lock 22.

Advantageously, it has been determined that the angle 52 between rear member 50 and trigger 20 is sufficient so that when the user pulls the trigger backwards toward the rear member the force is also translated to trigger lock 22 so as to move the trigger lock downwards. Stated another way, it has been determined by the present disclosure that the position of trigger lock 22 combined with the angle 52 of trigger 20 to rear member 50 allows the simple pulling of the trigger rearward to also unlock the trigger. Accordingly, simply pulling back on trigger assembly 18 while resting the user's fingers on trigger lock 22 allows trash to be stripped from pin 12 in one easy, single handed movement.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the present disclosure.

The invention claimed is:

1. A trash spearing tool, comprising:

a spearing pin;

a trigger assembly movable between a normal position and an activated position;

an inner tube depending from the trigger assembly; and an outer tube being disposed over a portion the inner tube and being slidable between a storage position and a use position, wherein the spearing pin is operatively coupled to the trigger assembly in such manner that, when the outer tube is in the use position and the trigger assembly is in the normal position, the spearing pin is normally biased to an extended position in which a portion of the spearing pin extends from the outer tube and, when the outer tube is in the storage position and the trigger assembly is in either the normal position or use position, the spearing pin is in a retracted position in which the spearing pin does not extend from the outer tube.

2. The trash spearing tool of claim 1, wherein, when the outer tube is in the use position, movement of the trigger assembly from the normal position to the activated position moves the spearing pin to the retracted position.

3. The trash spearing tool of claim 1, wherein the spearing pin is operatively coupled to the trigger assembly by a link rod, a spring retainer, and a biasing member, the spring retainer being secured in the inner tube and having a bore through which the link rod passes, the bore being sufficient to allow the link rod to move through the spring retainer.

4. The trash spearing tool of claim 3, wherein the biasing member is within the inner tube and acts on the spring retainer and the spearing pin to normally bias the spearing pin to the extended position and to bias the trigger assembly to the normal position.

5. The trash spearing tool of claim 3, wherein, when the outer tube is in the use position, movement of the trigger assembly from the normal position to the activated position overcomes the force of the biasing member to move the spearing pin to the retracted position.

6. The trash spearing tool of claim 3, wherein the biasing member is a compression spring.

7. The trash spearing tool of claim 3, further comprising a pin retainer, the biasing member being operatively positioned between the pin retainer and the spring retainer.

8. The trash spearing tool of claim 7, wherein the spearing pin is removably secured to the pin retainer.

9. The trash spearing tool of claim 7, wherein the spearing pin is connected to or unitary with a pin housing, the pin housing being removably connected to pin retainer by at least one connector.

10. The trash spearing tool of claim 1, further comprising one or more openings defined through the outer tube and a retractable detent removably receivable in the one or more openings to secure the outer tube in a desired location with respect to inner tube.

11. The trash spearing tool of claim 1, wherein the trigger assembly comprises a trigger, a trigger lock, and a second biasing member, the trigger being pivotable about a pivot point between the normal and activated positions, the second biasing member biasing the trigger lock to a locked position that prevents pivoting of the trigger from the normal position, and, thus, to prevent movement of the spearing pin from the extended position, when the outer tube is in the use position.

12. The trash spearing tool of claim 11, wherein the trigger lock is movable from the locked position to an unlocked position that allows pivoting of the trigger from the normal position to the activated position, and, thus, to allow movement of the spearing pin to the retracted position, when the outer tube is in the use position.

13. The trash spearing tool of claim 11, wherein the trigger assembly further comprises a rear member, the trigger having an angle with respect to the rear member in the normal position, and wherein the trigger lock is positioned on the trigger in such a manner that pulling back on the trigger while resting a user's fingers on the trigger lock is sufficient to both move the trigger lock from the locked position to the unlocked position and move the trigger from the normal position to the activated position.

* * * * *